US007774874B2

(12) United States Patent
Pressler

(10) Patent No.: US 7,774,874 B2
(45) Date of Patent: Aug. 17, 2010

(54) CRIB BUMPER

(76) Inventor: Margaret Webb Pressler, 2210 20th St. NW., Washington, DC (US) 20009

( * ) Notice: Subject to any disclaimer, the term of this patent is extended or adjusted under 35 U.S.C. 154(b) by 0 days.

(21) Appl. No.: 11/832,235

(22) Filed: Aug. 1, 2007

(65) Prior Publication Data

US 2009/0031496 A1 Feb. 5, 2009

(51) Int. Cl.
*A47C 31/00* (2006.01)

(52) U.S. Cl. ..... 5/424; 5/946; 5/425

(58) Field of Classification Search ..... 5/946, 5/93.1, 424–425, 655
See application file for complete search history.

(56) References Cited

U.S. PATENT DOCUMENTS

| | | | | |
|---|---|---|---|---|
| 3,619,824 | A * | 11/1971 | Doyle | 5/143 |
| 4,800,600 | A | 1/1989 | Baum | |
| 5,216,772 | A * | 6/1993 | Clute | 5/655 |
| 5,473,785 | A * | 12/1995 | Lager et al. | 5/655 |
| 5,960,493 | A * | 10/1999 | Rhey et al. | 5/424 |
| 6,178,573 | B1 | 1/2001 | Wagner et al. | |
| 6,393,639 | B1 | 5/2002 | Ohsner | |
| 6,438,775 | B1 | 8/2002 | Koenig | |
| 6,615,426 | B1 * | 9/2003 | Risk, Jr. | 5/425 |
| 6,848,130 | B1 * | 2/2005 | Wilson | 5/425 |
| 6,957,455 | B1 | 10/2005 | Misson | |
| 7,055,192 | B2 | 6/2006 | Waters et al. | |
| 2006/0042013 | A1 | 3/2006 | Madsen | |
| 2006/0075555 | A1 | 4/2006 | Komisar | |

OTHER PUBLICATIONS

Patent Application Publication 2006/00755555 to Komisar.*
PCT/US08/71781, International Search Report, dated Oct. 22, 2008.
PCT/US08/71781, Written Opinion, dated Oct. 22, 2008.

* cited by examiner

*Primary Examiner*—Fredrick Conley
(74) *Attorney, Agent, or Firm*—Banner & Witcoff, Ltd.

(57) ABSTRACT

A crib bumper for use in a baby crib is presented. The crib bumper includes at least one bumper section of dense non-absorbent material. The crib bumper may include a plurality of bumper segments abutting each other lengthwise to extend the length or width of a crib. The crib bumper may include a cover having an aperture through which a crib bumper section or crib bumper segments may be placed inside the cover. The cover may be formed of a washable material and may include a mechanism for closing the aperture to prevent the crib bumper from slipping out of the cover. In addition, the cover may include one or more connectors for connecting the cover to the crib.

13 Claims, 6 Drawing Sheets

CRIB BUMPER

TECHNICAL FIELD

This application relates generally to a crib bumper. More particularly, this application relates to a crib bumper formed of a firm, non-absorbent material configured for use in a conventional baby crib.

BACKGROUND

Crib bumper pads have been commonly used in baby cribs for various reasons. Crib bumper pads generally are arranged on the inside of the crib and line entire sides and/or font and rear panels of a crib. Crib bumper pads are used to protect an infant from injury caused by bumping into the sides of the crib or from sticking their arms and legs through the slats of a crib. Crib bumper pads are also used for purely aesthetic reasons, as they add decoration and may match the sheets or bedding in a crib.

As a child grows, the child may use the crib bumper pad as a step to aid in exiting the crib, which may cause injury to the child. Some resources propose removing crib bumpers as children become old enough to climb out of the crib. However, removal of the bumper entirely leaves the slats of a crib exposed which may allow a child to lodge his arm, leg or head between the slats. In addition, the exposed slats generally allow toys, pacifiers, etc. to fall out of the crib.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

A crib bumper is provided. In one arrangement, the crib bumper includes at least one crib bumper section, wherein the at least one crib bumper section is configured to extend along the length of a side of a crib. The crib bumper section may include a first side and a second side, wherein the first and second sides are substantially perpendicular to each other. The crib bumper section may extend along one or more sides of the crib and, in one arrangement, may have a triangular cross section.

In another arrangement, the crib bumper may include a plurality of crib bumper segments, each of the plurality of crib bumper segments having a first end and a second end, wherein, in a first configuration, each of the plurality of crib bumper segments are arranged with at least one of the first end and second end abutting at least one of the first end and second end of another of the plurality of crib bumper segments. When positioned in the first configuration, the plurality of crib bumper segments form a crib bumper section that extends along the length of a side of a crib. Each of the plurality of crib bumper segments includes a first side and a second side that are substantially perpendicular to each other.

In yet another arrangement, the crib bumper may be part of a kit. For instance, the kit may include a first plurality of crib bumper segments having a first side and a second side and forming a first crib bumper section. The kit may also include a first cover that substantially surrounds the first plurality of crib bumper segments, the first cover including at least one aperture through which the first plurality of crib bumper segments is inserted into the first cover and means for closing the first cover around the first crib bumper section. In addition, the kit may include, a second plurality of crib bumper segments having a first side and a second side and forming a second crib bumper section. Further, the kit may generally include a second cover that substantially surrounds the second plurality of crib bumper segments, the second cover including at least one aperture through which the second plurality of crib bumper segments is inserted into the second cover and means for closing the second cover around the second crib bumper section.

DETAILED DESCRIPTION OF THE DRAWINGS

The following discussion and accompanying figures disclose a crib bumper for use in a baby crib. The crib bumper may be used in any type of baby crib including substantially rectangular cribs having slats on two sides or slats on four sides, round cribs, folding cribs, cradles, bassinettes, and the like, each of which may be referred to herein as a "crib". For ease of understanding, the crib bumper will be described as being used with a conventional, substantially rectangular crib having slats on two sides or four sides.

Figure 1:
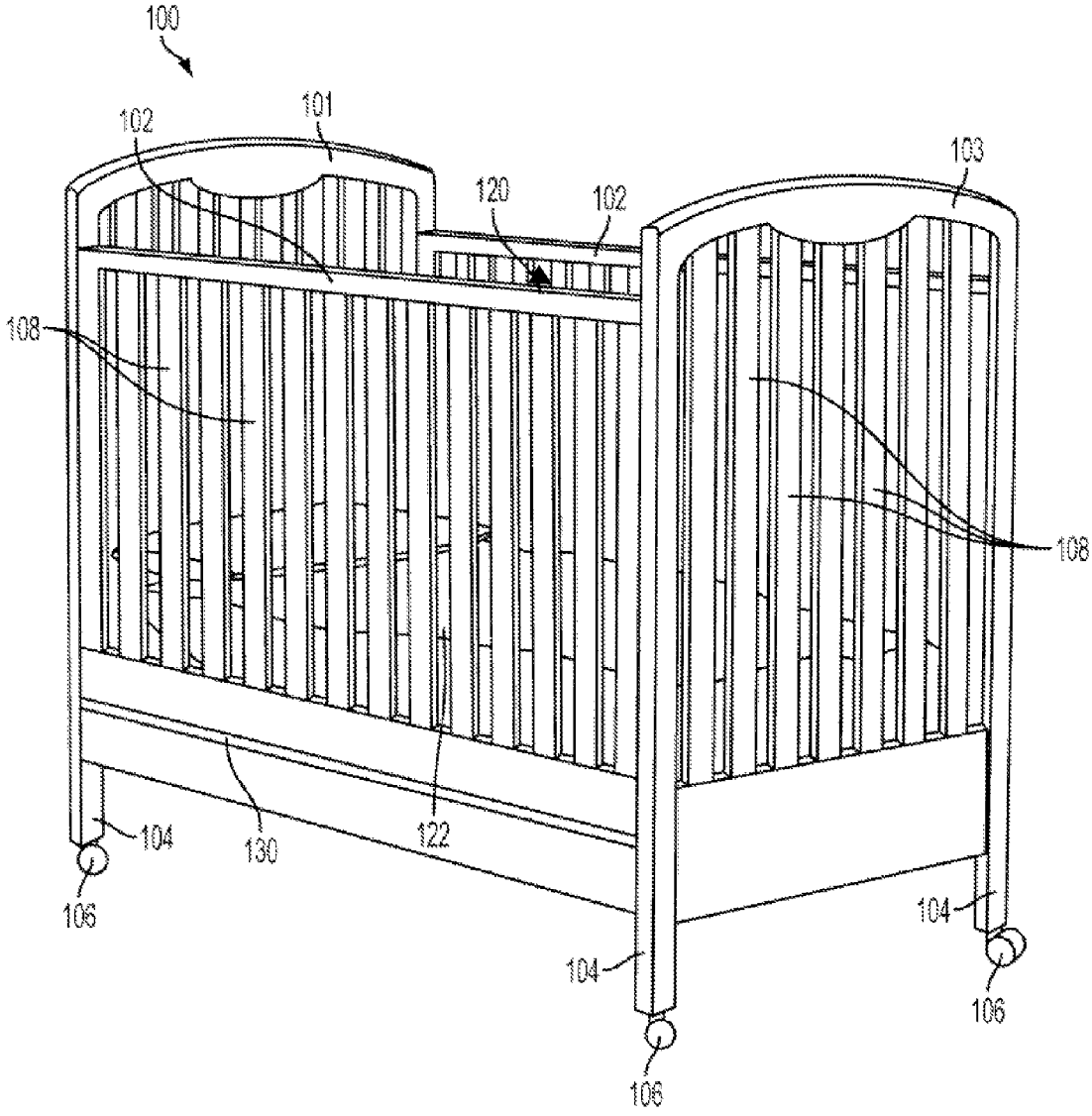
FIG. 1 is a perspective view of a baby crib.

For purposes of general reference, FIG. 1 illustrates a baby crib 100. The crib 100 generally includes two sides 102, a front portion 101 and a rear portion 103, set atop legs 104 that raise the crib 100 off the floor. As shown in FIG. 1, the legs may include rollers or casters 106 that provide ease of movement of the crib. The sides 102 of the crib 100 generally include slats 108 or spindles on one or more sides 102. In addition, the front 101 and rear 103 portions may include slats 108. In some arrangements, two sides 102 of the crib may include slats while the front 101 and rear 103 portions may be solid panels. The slats 108 provide visual access to the interior of the crib 100. However, the slats 108 also provide openings through which a child may extend an arm or leg. Further, the slats provide gaps through which toys, pacifiers and other items in the crib may fall or be pushed out of the crib 100.

The sides of the crib form an interior area 120 of the crib 100 in which a mattress 122 is arranged. In addition, the crib 100 may include an appropriate apparatus 130 for raising or lowering one or more of the sides 102 of the crib 100 to provide ease of access to the interior area 120 of the crib 100.

Figure 2:
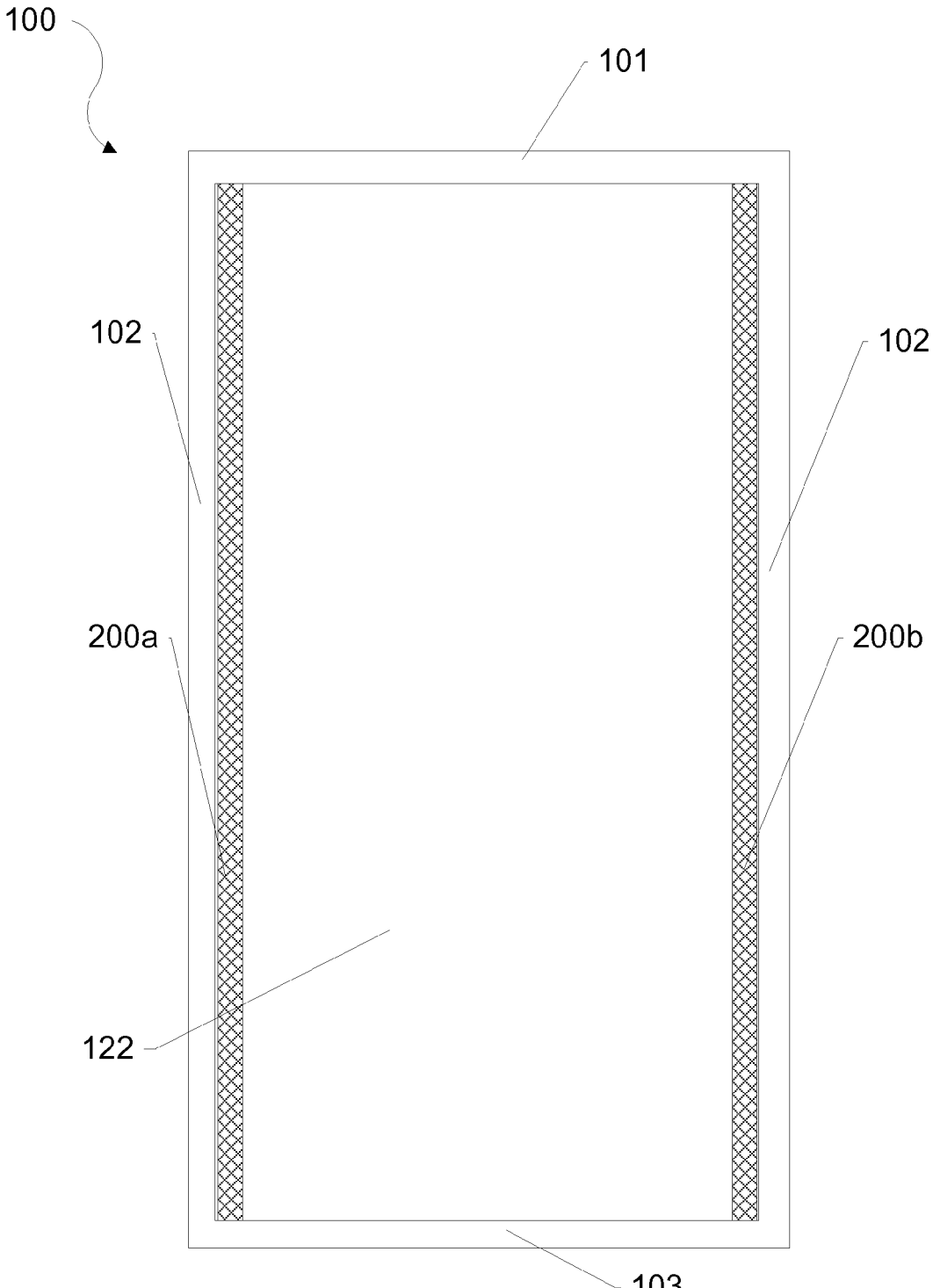
FIG. 2 is a top view of a baby crib showing a crib bumper according to one arrangement described herein.

With reference to FIG. 2, a crib bumper 200 may be used in a baby crib 100 to protect an infant from bumping his or her head against the sides of the crib 100, sticking their arms and/or legs through the slats 108 of a crib 100, and to keep items such as toys, pacifiers, and the like, within a crib 100. In the arrangements shown, a crib bumper 200 may be positioned in the interior area 120 of the crib 100 abutting the mattress 122 and one or more sides of the crib. In one illustrative arrangement shown in FIG. 2, the crib bumper 200 may be positioned along two sides 102 of the crib. In an alternative arrangement shown in FIG. 3, the crib bumper 200 may line two sides 102 of a crib 100 and the front 101 and rear 103 portions of the crib 100. In at least some arrangements, the crib bumper 200 generally includes at least one bumper section. In some arrangements, the crib bumper 200 may include four sections. The crib bumper 200 may also include a cover (500 in FIG. 6). A "bumper section" refers to a portion of the crib bumper configured to fit within a single side or predefined portion of a baby crib.

With further reference to FIG. 2, the crib bumper 200 may include a single bumper section 200*a* or 200*b*, that is arranged along one side 102 of the crib 100. In one example, the crib bumper 200 may include two single bumper sections 200*a*, 200*b*, one arranged along each side 102 of the crib 100. In the arrangement shown, the crib bumper 200 extends from the front portion 101 of the crib to the rear portion 103 of the crib 100. In some arrangements, the single bumper section 200*a*, 200*b* may be between 45 and 55 inches. In still other arrangements, the single bumper section 200*a*, 200*b* may be between 47 and 53 inches. Although the bumper section 200*a*, 200*b* may be formed in the recited size ranges to fit a standard crib 100, the single bumper section 200*a*, 200*b* may be formed in any length to fit portable crib, foldable cribs, bassinettes, and the like. In addition, the single crib bumper section may be custom made in any length to fit non-standard sized cribs or non-rectangular cribs.

The crib bumper 200 may be formed of any material firm enough to hold a desired shape of the bumper 200. In one arrangement, the crib bumper 200 is made of a flexible, dense material. In one arrangement, the crib bumper 200 may be made of foam, such as polyethylene foam, rubber blended foam, and the like. In addition, the crib bumper may be made of any suitable material that is pliant. For example, the crib bumper 200 may be formed to resist deformation but be pliant enough to allow some flexibility. A variety of materials may be used to fabricate the crib bumper 200. In one arrangement, the material may be selected based on the firmness. Because the crib bumper 200 may be in close proximity to a child's face, there may be a risk of suffocation or Sudden Infant Death Syndrome. In order to minimize this risk, a material with greater stiffness or density may be selected that will not likely cover the airway of the infant, which may cause suffocation. In addition, a non-absorbent material may be used to prevent spit-up or other excretions from being absorbed into the crib bumper 200. The non-absorbent material may allow the crib bumper 200 to be cleaned by wiping off any dirt or foreign matter.

Figure 3:
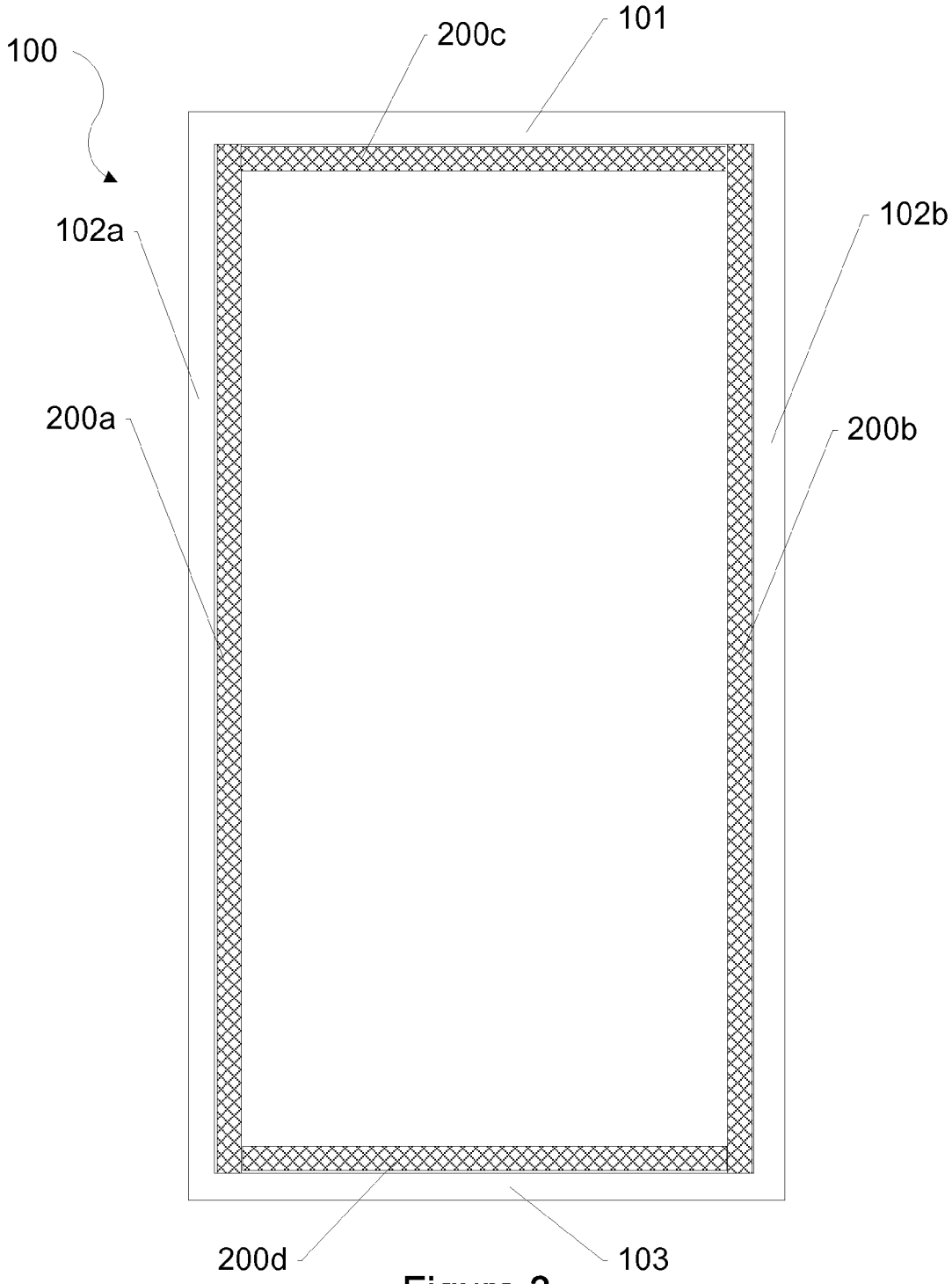
FIG. 3 is a top view of a baby crib showing an alternate arrangement of a crib bumper.

In an alternative arrangement shown in FIG. 3, the crib bumper 200 includes four crib bumper sections 200*a*-200*d* that are arranged to extend along each side of the crib 100. For instance, the crib bumper shown includes four sections: side bumpers 200*a*, 200*b* extending along each of the long sides 102 of the crib, one bumper section 200*c* extending along the front portion 101 of the crib 100 and one bumper section 200*d* extending along the rear portion 103 of the crib 100. In the arrangement of FIG. 3, the crib bumper sections 200*a*, 200*b* along sides 102 may be similar to those described in FIG. 2. The crib bumper sections 200*c*, 200*d* along the front 101 and rear 103 portions of the crib 100 may generally extend between each of the sides 102 of the crib 100. In some arrangements, the crib bumper sections 200*c*, 200*d* may be between 20 and 30 inches. In still other arrangements, the sections 200*c*, 200*d* may be between 23 and 29 inches. The number of bumper sections may vary in different crib configurations and may be adjusted to fit the length, width, or other dimensions of crib 100.

Figure 4:
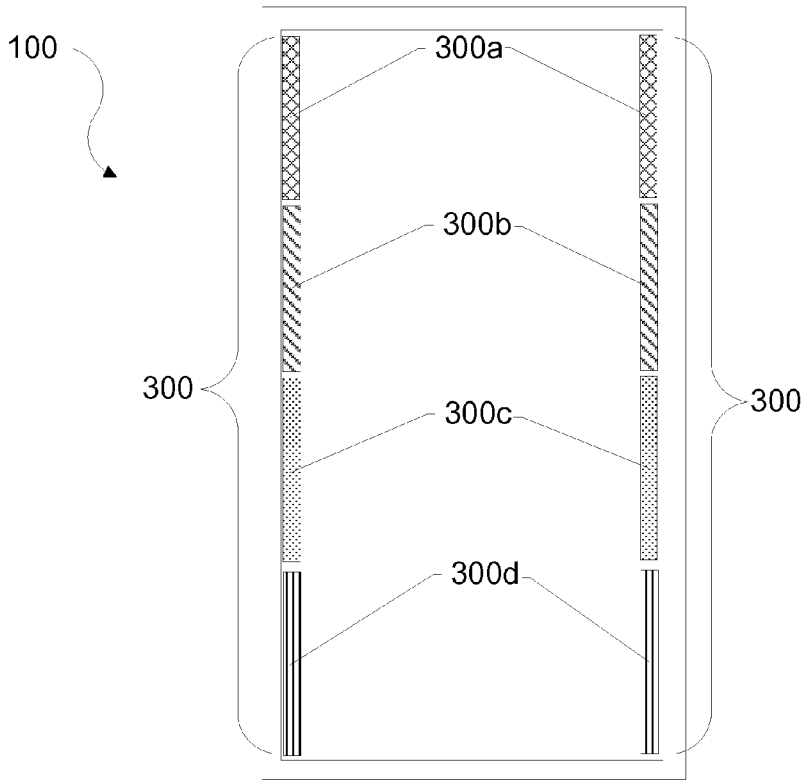
FIG. 4 is a top view of a baby crib showing yet another alternate arrangement of a crib bumper.

In yet another arrangement shown in FIG. 4, the crib bumper 300 may include a plurality of bumper segments 300*a*-300*d* that have a first end and a second end. The bumper segments 300*a*-300*d* may be positioned end to end, that is the first end of one segment abutting a first end of another segment, etc., to extend along the length of one or more sides 102 of the crib 100. For example, crib bumper 300 in FIG. 4 includes four bumper segments, 300*a*-300*d*. Each of the bumper segments 300*a*-300*d* may be equal in length, or, in another arrangement, one or more of the segments 300*a*-300*d* may be shorter or longer than one or more of the other segments 300*a*-300*d*. In one arrangement, each of the bumper segments 300*a*-300*d* may be between 10 and 14 inches. For example, each of the segments 300*a*-300*d* may be approximately 12.75 inches in length to allow for the length of each segment to equal the length of one side of a standard crib. The total length of the bumper segments, when positioned end to end, may extend the entire length of the crib side 102. This arrangement allows for further customization of the length of the crib bumper. In addition, this arrangement may allow for ease of assembly when the crib bumper 300 is used with a cover, as will be described below.

Figure 5:
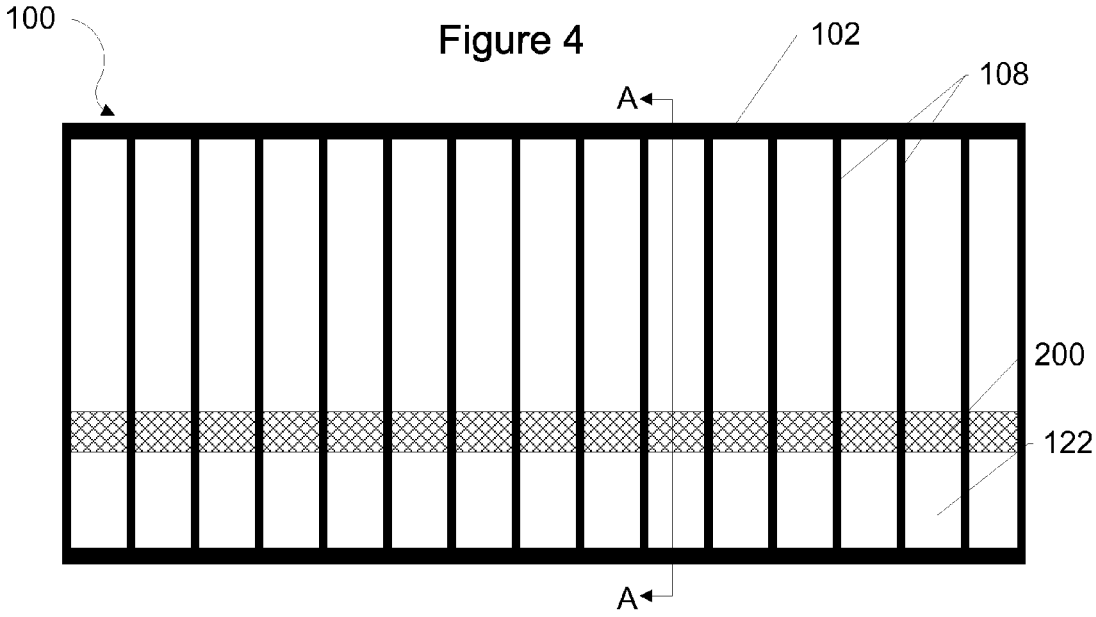
FIG. 5 is a side view of a portion of a baby crib showing one illustrative configuration of the crib bumper.

FIG. 5 is a side view of an upper portion of crib 100 showing one illustrative arrangement. As shown, the crib bumper 200 is positioned above the mattress 122. In the arrangement shown, the crib bumper is positioned to rest on top of the mattress 122. The addition of the crib bumper 200 on top of the mattress 122 acts as a barrier to prevent a child's arms, legs, toys, and the like, from protruding through the slats of the crib 100.

Figure 6:
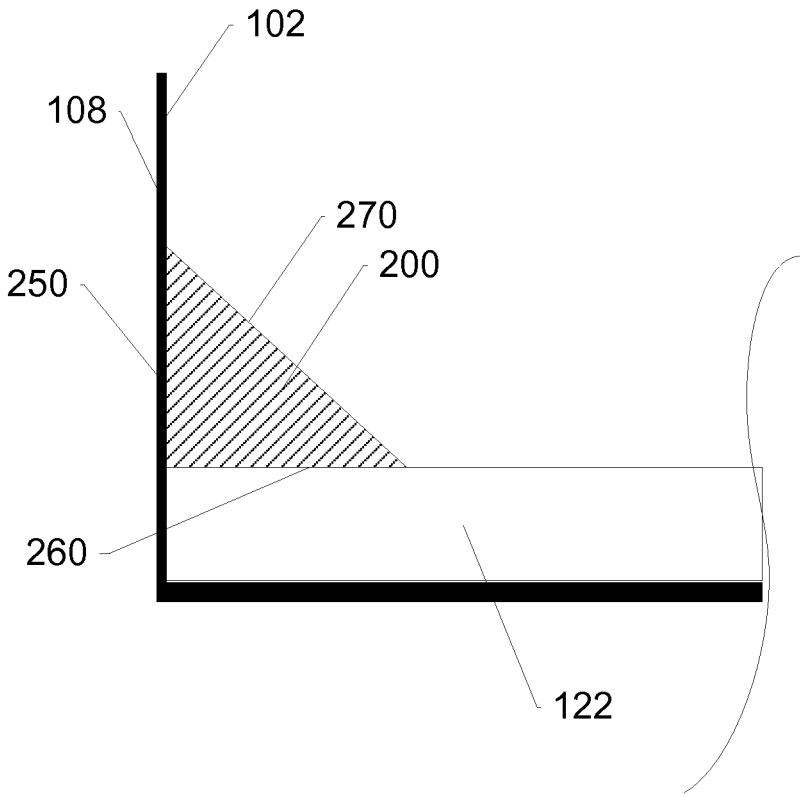
FIG. 6 is a cross-sectional view taken along line A-A of FIG. 5, of one arrangement of the crib bumper described herein.

FIG. 6 is a cross sectional view of the crib 100 taken along A-A. In at least one illustrative arrangement, the crib bumper 200 has a generally triangular cross-section. For example, the cross section of the crib bumper may be triangular and may include a 90° angle. The crib bumper 200 may have cross sections of alternate shapes, such as square, rectangular, hexagonal, octagonal, trapezoidal and the like. In the arrangement shown in FIG. 6, the crib bumper 200 includes a first side 250, a second side 260, and a third side 270. The first side 250 is arranged to abut or to rest against the side of the crib 102 and, in particular crib slats 108. The first side 250 may be any suitable height to prevent objects from passing between the slats 108 of the crib 100. In one arrangement, the first bumper side 250 has a length between 1.5 and 5.0 inches. In still another arrangement, the first bumper side 250 has a length of approximately 2.5 inches. The height of the first side 250 may also be low enough to prevent the child from using the crib bumper 200 as an aid to exit the crib 100.

The second side 260 of the crib bumper 200 is arranged to abut or to rest atop the crib mattress 122. The second bumper side 260 may be any suitable length to maintain the position of the crib bumper 200 and provide stability to the crib bumper 200. In one arrangement, the second crib bumper side 260 has a length between 1.5 and 3.5 inches. In still another arrangement, the second bumper side 260 has a length of approximately 2 inches. In some arrangements, the ratio of the length of the first side to the second side may be between 1:1 and 3:1. In one particular arrangement, the ratio of the length of the first side to the length of the second side may be 1.25:1. The relative length of the first side to the second side aids in providing stability to the bumper within the crib. The first bumper side 250 and second bumper side 260 may form approximately a 90 degree angle to mimic the angle formed between the mattress 122 and the slats 108 of the crib 100 and to comfortably and stably fit within the interior area of the crib 100. The length of the crib bumper sides may reduce the possibility of an infant or child using the crib bumper 200 as a step to climb over the sides 102 of the crib 100, which may cause injury to the child. The third bumper side 270 is generally angled upward from the mattress 122. The upward angle aids in preventing toys and the like from being pushed out of the crib 100.

Figure 7:
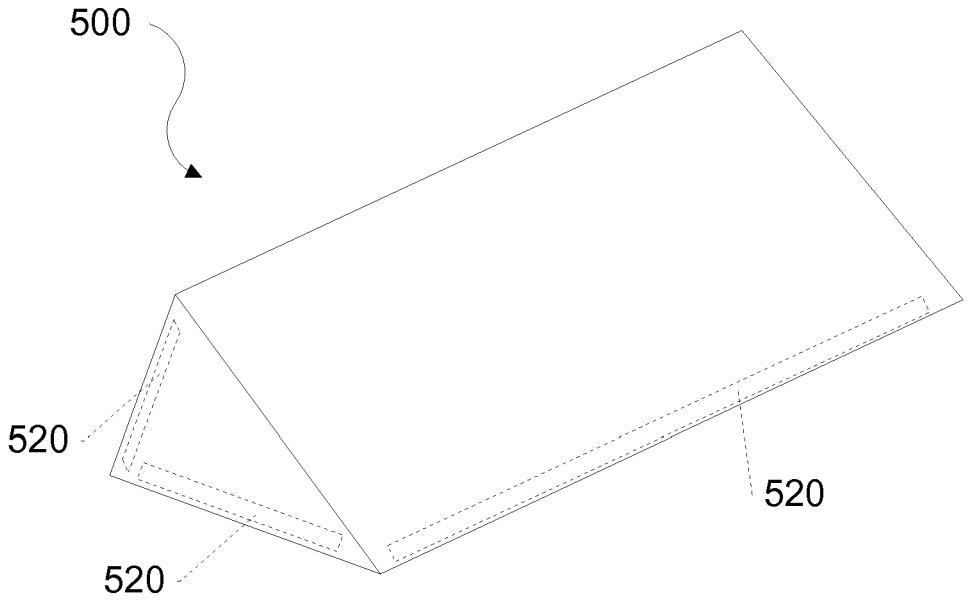
FIG. 7 is a perspective view of a cover that may be used with some arrangements of the crib bumper described herein.

In some arrangements, the crib bumper 200 may include a cover 500, as shown in FIG. 7, which substantially surrounds the crib bumper. The cover may be open at one or more ends or along one or more sides. The cover 500 may generally be shaped to fit snugly over the crib bumper. The cover 500 may be formed of any suitable material, such as cotton, nylon, flannel, etc. In some examples, the cover 500 may be washable to permit ease of cleaning should the cover become soiled. The cover 500 may also include decorative patterns, designs, and the like to add stimulation to the crib environment. For example, the cover 500 may be pink for little girls or blue for little boys, or the decorative patterns may match the patterns or theme of the bedding and/or other nursery decor.

As mentioned above, cover 500 has at least one opening or aperture through which the crib bumper may be inserted into the cover 500 The cover 500 may include an aperture at one end, two ends, along a side, etc. The aperture may include a closure, such as 520 in FIG. 7, to prevent the crib bumper from slipping out of the cover 500. This closure may include any suitable mechanism for removable attachment of the connecting portions of the cover 500. For instance, the closure may include buttons, snaps, hook and loop closure, such as VELCRO®, and the like. In an alternate arrangement, the cover 500 may be sewn around the crib bumper to provide a more permanent cover. The closure may be positioned along the length of the cover or at one or more ends. In addition, the closure may be opened and closed to allow a parent or caregiver to easily change the cover 500 on the crib bumper 200 or remove it for washing.

Figure 8:
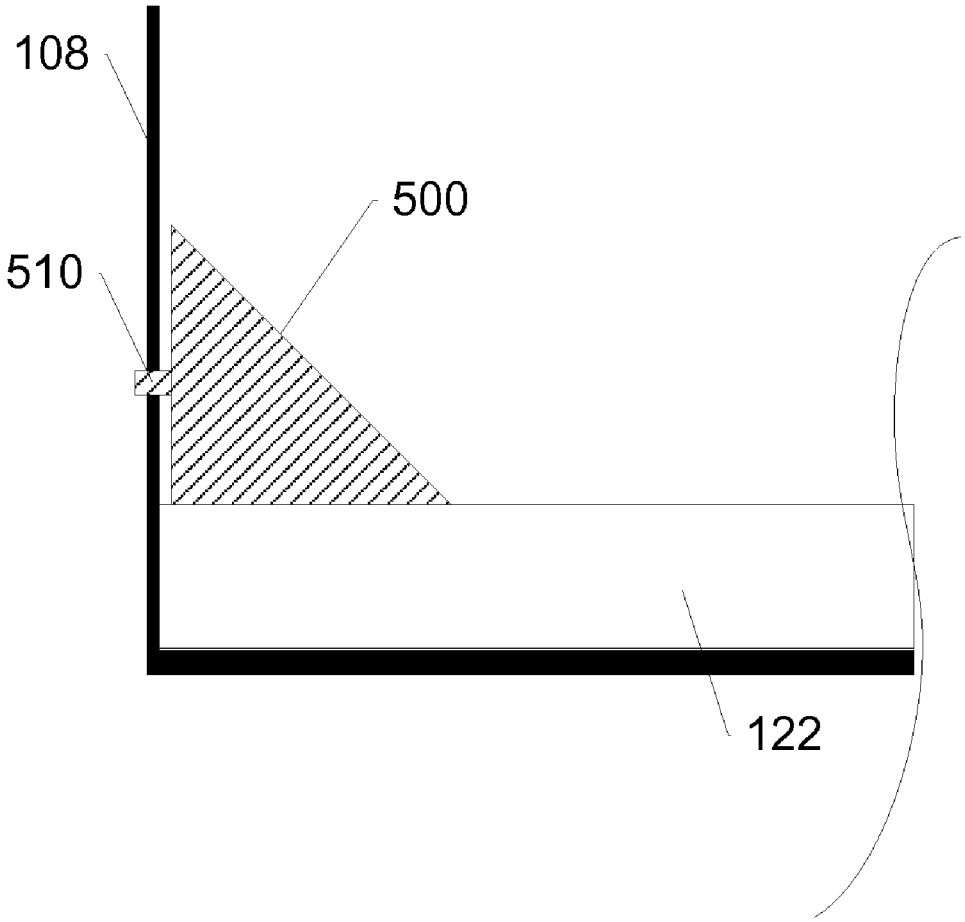
FIG. 8 is a cross-sectional view of one arrangement of the crib bumper illustrating connection of the crib bumper to the crib.

As illustrated in FIG. 8, the cover 500 may include a connector 510 to connect the cover 500 to the crib 100 and, in some arrangements to the slats 108 of the crib 100. The connector 510 may be any suitable type of connector to join the cover 500 and the crib, such as material extensions that wrap around one or more slats and connect to each other using buttons, snaps, ties, hook and loop closure, such as VELCRO®, and the like. The connector 510 generally provides for ease of attachment and removal of the cover 500 to and/or from the crib 100. In addition, the connector should be of a type that can be broken in the event a child should become entangled in it. In some arrangements, the cover 500 may include a plurality of connectors 510 arranged at various points along the length of the cover 500. For example, the cover 500 may have two connectors 510 positioned at ⅓ of the length of the crib bumper 200 and ⅔ of the length of the crib bumper 200, from the front of the crib 100. In another example, the cover 500 may include more than two connectors 510, arranged at varying positions along the length of the cover 500. In arrangements wherein a cover 500 is not used, the connector may be formed directly to the crib bumper 200, to permit direct connection of the crib bumper 200 to the crib 100.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Numerous other embodiments, modifications and variations within the scope and spirit of the appended claims will occur to persons of ordinary skill in the art from a review of this disclosure.

What is claimed is:

1. A kit for a crib bumper, comprising:

a first crib bumper section having at least three firm crib bumper segments, each of the at least three crib bumper segments having a first end, a second end, a first side, a second side, and a third side, wherein the first side of each of the at least three crib bumper segments extends upward from a top surface of a mattress, is configured to abut a first side of a crib, and has a length between 1.5 and 3.5 inches, and the second side of each of the at least three crib bumper segments extends from the first side of the crib toward an interior of the crib, is configured to abut the mattress, and has a length between 1.5 and 3.5 inches, wherein the first and second sides of each of the at least three crib bumper segments are substantially perpendicular to each other to conform to a shape formed by the first side of the crib and the mattress, and the third side of each of the at least three crib bumper segments extends from an edge of the first side of the at least three crib bumper segments to an edge of the second side of the at least three crib bumper segments and forms a first angled surface within the interior of the crib configured to improve air flow within the crib, wherein each of the at least three crib bumper segments has a triangular cross section and is arranged with at least one of the first end and second end abutting at least one of the first end and second end of another of the at least three crib bumper segments to extend along a length of the first side of the crib;

a first cover that substantially surrounds the first crib bumper section, the first cover including at least one aperture through which the at least three crib bumper segments are inserted into the first cover and a first closure for closing the first cover around the first crib bumper section;

a second crib bumper section having at least three firm crib bumper segments, each of the at least three crib bumper segments having a first end, a second end, a first side, a second side, and a third side, wherein the first side of each of the at least three crib bumper segments extends upward from the top surface of the mattress, is configured to abut a second side of the crib, and has a length between 1.5 and 3.5 inches, and the second side of each of the at least three crib bumper segments extends from the second side of the crib toward the interior of the crib, is configured to abut the mattress, and has a length between 1.5 and 3.5 inches, wherein the first and second sides of each of the at least three crib bumper segments are substantially perpendicular to each other to conform to a shape formed by the second side of the crib and the mattress, and the third side of each of the at least three crib bumper segments extends from an edge of the first side of the at least three crib bumper segments to an edge of the second side of the at least three crib bumper segments and forms second angled surface within the interior of the crib configured to improve air flow within the crib, wherein each of the at least three crib bumper segments has a triangular cross section, and is arranged with at least one of the first end and second end abutting at least one of the first end and second end of another of the at least three crib bumper segments to extend along a length of the second side of the crib;

a second cover that substantially surrounds the second crib bumper section, the second cover including at least one aperture through which the at least three crib bumper segments are inserted into the second cover and a second closure for closing the second cover around the second crib bumper section, a third crib bumper section having at least two firm crib bumper segments, each of the at least two crib bumper segments having a first end, a second end, a first side, a second side, and a third side, wherein the first side of each of the at least two crib bumper segments extends upward from the top surface of the mattress, is configured to abut a top side of a crib, and has a length between 1.5 and 3.5 inches, and the second side of each of the at least two crib bumper segments extends from the top side of the crib toward the interior of the crib, is configured to abut the mattress, and has a length between 1.5 and 3.5 inches, wherein the first and second sides of each of the at least two crib bumper segments are substantially perpendicular to each other to conform to a shape formed by the top side of the crib and the mattress, and the third side of each of the at least two crib bumper segments extends from an edge of the first side of the at least two crib bumper segments to an edge of the second side of the at least two crib bumper segments and forms a third angled surface within the interior of the crib, wherein each of the at least two crib bumper segments has a triangular cross section and is arranged with at least one of the first end and second end abutting at least one of the first end and second end of another of the at least two crib bumper segments to extend along a length of the top side of the crib;

a third cover that substantially surrounds the third crib bumper section, the third cover including at least one aperture through which the at least two crib bumper segments are inserted into the third cover and a third closure for closing the third cover around the third crib bumper section;

a fourth crib bumper section having at least two firm crib bumper segments, each of the at least two crib bumper segments having a first end, a second end, a first side, a second side, and a third side, wherein the first side of each of the at least two crib bumper segments extends upward from the top surface of the mattress, is configured to abut a bottom side of a crib, and has a length between 1.5 and 3.5 inches, and the second side of each of the at least two crib bumper segments extends from the bottom side of the crib toward an interior of the crib, is configured to abut the mattress, and has a length between 1.5 and 3.5 inches, wherein the first and second sides of each of the at least two crib bumper segments are substantially perpendicular to each other to conform to a shape formed by the bottom side of the crib and the mattress, and the third side of each of the at least two crib bumper segments extends from an edge of the first side of the at least two crib bumper segments to an edge of the second side of the at least two crib bumper segments and forms a fourth angled surface within the interior of the crib, wherein each of the at least two crib bumper segments has a triangular cross section and is arranged with at least one of the first end and second end abutting at least one of the first end and second end of another of the at least two crib bumper segments to extend along a length of the bottom side of the crib; and a fourth cover that substantially surrounds the fourth crib bumper section, the fourth cover including at least one aperture through which the at least two crib bumper segments are inserted into the fourth cover and a fourth closure for closing the fourth cover around the fourth crib bumper section.

2. The kit of claim 1, further including a plurality of connectors, fixedly attached to the first and second cover and configured for removable connection of the first and second cover to the crib.

3. The kit of claim 2, wherein at least one of the plurality of connectors is configured to be attached to a first slat along the length of the side of the crib and at least one of the plurality of connectors is configured to be attached to a last slat along the length of the side of the crib.

4. The kit of claim 2, wherein at least one of the plurality of connectors is configured to be attached to the crib at one-third of the length of the side of the crib and at least one of the plurality of connectors is configured to be attached to the crib at two-thirds of the length of the side of the crib.

5. The kit of claim 2, wherein at least one of the plurality of connectors is configured to be attached to a corner post of the crib.

6. The kit of claim 2, further including a plurality of connectors, fixedly attached to the third and fourth cover and configured for removable connection of the third and fourth cover to the crib.

7. The kit of claim 1, wherein the first cover and second cover are independent from each other.

8. The kit of claim 1, wherein the first cover and third cover are integral with each other and the second cover and fourth cover are integral with each other.

9. The kit of claim 8, wherein the third cover is connected to the second cover and the first cover is connected to the fourth cover.

10. The kit of claim 1, wherein the first cover is connected to the third cover and the second cover is connected to the fourth cover.

11. The kit of claim 1, wherein the first, second, third, and fourth crib bumper sections are formed of a non-absorbent material.

12. The kit of claim 1, wherein the first side of the crib and the second side of the crib are parallel to each other and the length of the first side of the crib and the length of the second side of the crib are equal.

13. The kit of claim 1, wherein the first, second, third, and fourth angled surfaces form a similar angle.

* * * * *